United States Patent [19]

Stump

[11] 4,161,112

[45] Jul. 17, 1979

[54] TUBE DRAWING TECHNIQUE

[75] Inventor: Paul E. Stump, Beaver Falls, Pa.

[73] Assignee: The Babcock & Wilcox Company, New York, N.Y.

[21] Appl. No.: 879,285

[22] Filed: Feb. 21, 1978

[51] Int. Cl.[2] ..... B21C 3/16

[52] U.S. Cl. ..... 72/283; 72/479

[58] Field of Search ..... 72/283, 478, 479

[56] References Cited

U.S. PATENT DOCUMENTS

| | | | |
|---|---|---|---|
| 1,685,636 | 9/1928 | Kemp | 72/478 |
| 2,306,712 | 12/1942 | Poncar | 72/283 |
| 2,663,410 | 12/1953 | Kessler | 72/283 |
| 3,783,663 | 1/1974 | Prajsnar et al. | 72/283 |

FOREIGN PATENT DOCUMENTS

| | | | |
|---|---|---|---|
| 635413 | 3/1962 | Italy | 72/283 |

*Primary Examiner*—Michael J. Keenan

*Attorney, Agent, or Firm*—Joseph M. Maguire; Angelo Notaro

[57] ABSTRACT

A method of tube drawing a cold finished stepped internal diameter tube utilizing a novel mandrel plug having compound working surfaces designed to automatically adjust to the varying internal diameters formed in a tube hollow to be worked as it is drawn through a die.

6 Claims, 3 Drawing Figures

TUBE DRAWING TECHNIQUE

BACKGROUND OF THE INVENTION

This invention relates to a method for manufacturing tubing and, more particularly, to an improved method and mandrel plug for the production of cold drawn tubes having varying diameters.

Cold drawing, as used in the production of tubular products, may be generally characterized as the reduction of the diameter and wall thickness of a tube shell or hollow by drawing it through a fixed cold reduction die. Several processes of cold drawing tubes are conventionally utilized.

Cold drawing a tubular hollow through a die without an internal mandrel, for example, is known as sinking or sink drawing. In a sinking process, only the diameter of the tube hollow is reduced. The wall thickness is essentially maintained but may be slightly increased or decreased depending upon the ratio of the wall thickness to the tube diameter. A sink drawing technique is utilized if the outside diameter must be only slightly reduced to achieve a desired size and tolerance, or if it is not otherwise necessary to reduce the wall thickness.

Simultaneous wall thickness and tube diameter reductions may be achieved by several drawing methods including drawing with a stationary mandrel, drawing with a floating plug mandrel, or drawing with a moving mandrel.

In drawing with a stationary mandrel, a cylindrical mandrel plug is rigidly coupled to an elongated mandrel rod of smaller cross section. The mandrel plug is fixed in position within a die opening thereby forming an annulus between the cylindrical mandrel plug and die opening. The die opening, typically smaller than the outside diameter of the tube hollow which is to be cold worked, is provided with a tapered entrance or approach leading to a circular die land (bearing zone). A tube hollow is drawn through the annulus reducing its diameter and thickness. The cross section of the tube passing from the die opening is approximately equal to the cross section of the annulus at the die land.

In the floating plug method of tube drawing, the mandrel plug is not fixed to a rod. The floating plug is configured to automatically adjust itself to the correct operating position during the drawing operation. Typically, the floating plug has a contour that includes a conical portion and cylindrical portion. The cylindrical portion of the plug acts in a manner similar to a stationary mandrel. The angles of the conical portion of the plug and the tapered entrance of the die are such that as the tube hollow is drawn through the die, frictional forces arising between the plug and the inside surface of the tube hollow, cause the plug to automatically adjust or float, and position the plug to form an annulus of constant size between the cylindrical portion of the plug and the die land. Long tubes can be cold drawn by this technique, since the weight and length of a connecting mandrel rod are not a consideration.

Drawing with a moving mandrel encompasses the use of a long internally disposed rod which moves with a circumscribed tube hollow through the die. Drawing with a moving mandrel is usually restricted to the production of small diameter or thin walled tubing wherein the rod which would have to be attached to a stationary mandrel would be too thin to maintain its structural integrity or where friction between a fixed or floating plug might damage the thin walled tubing.

Cold drawing is often employed to produce tubing with mechanical properties or qualities which cannot be obtained with standard hot rolling operations. Cold drawing is utilized to form tubes with thinner walls and improved dimensional tolerances; to achieve greater mechanical properties including yield strength, ultimate tensile strength and hardness; and, to produce non-standard sizes, shapes or sections.

The quality of the tube hollows has considerable bearing on the quality of the finished tube. Therefore, several preliminary operations are performed. First, the tube hollow is cut to the proper length for drawing. One end of the tube hollow is then pointed or swaged. This end will subsequently be gripped by a mechanism, typically a draw carriage, which will actually draw the tube hollow through the die. The tube hollow may next be annealed to facilitate the cold working by softening, to add ductility or to develop the proper metal microstructure. The tube hollow is pickled in dilute acid solutions to remove scale and surface dirt. After pickling, the tube hollow is carefully inspected to assure the absence of off-mill imperfections or defects such as seams, slivers and mill marks that can have deleterious effects on the finished tube. Any defects found are removed prior to the drawing operations. The tube hollow is then lubricated to minimize the frictional forces which will arise as it is drawn through the die. Multiple pass drawing operations, wherein several draw passes are required to produce the desired product, generally necessitate intermediate annealing and repetition of a number of these preparatory steps.

Tubular wall reductions achievable in a draw pass have practical limitations. The amount of wall reduction that a tube can physically withstand per draw pass without damage is a function of its ductility. However, the amount of reduction of area in one pass should generally not exceed thirty-five percent.

Shaped tubes and variable section—stepped internal diameter—tubes are employed in engineering for manufacturing parts for different industries. A basic purpose for using variable section tubing is to produce lighter tubular structures while maintaining strength and saving metal. Tubes having stepped diameters may be fabricated so as to minimize subsequent machining operations, for instance, where a tubular product is to be subjected to a final internal boring to achieve a precision tolerance or dimension. Stepped tubes may also be useful where varying or extra wall thickness is necessary for subsequent operations such as bending, for connections to tubes of different wall thickness or diameter, or to a header or tube sheet having uniform tube holes, or for maximizing the number of tubes in a given space.

In order to form a stepped cold finished tube, it is generally necessary to subject the wall of the tube hollow which will constitute the thinner section to several cold drawing passes. Typically, a portion of the tube hollow is sunk drawn to a predetermined length substantially maintaining the initial wall thickness. A stationary mandrel is positioned within the hollow. The hollow is passed further on through the die, reducing the wall of a succeeding portion of the hollow, and producing a step in internal diameter at the interface of the original and reduced cross-section portions. In order to further reduce the walls the hollows must be annealed and subjected to a number of preparatory steps, such as described, prior to further drawing. Further reduction of the tube hollow to produce a finished tube may be accomplished by repeating the described steps.

Significant disadvantages are inherent in this procedure. The repeated outside diameter reduction by sinking (without a mandrel) of the heavy wall part of the tube tends to produce very small but significant defects on the inside surface of the sunk part of the tube. In the presence of residual or service stresses in the walls of such tubes, such as might result from cold sinking, from certain heat treatments, or from the presence of an internal fluid under pressure, these small defects can cause local concentrations of stress sufficient to cause splitting of the tube wall, either during manufacture of the tube or later in service. Furthermore, accurate repositioning of the mandrel plug at the exact time of arrival of the preliminary step upon subsequent passes is quite difficult and is not conducive to producing a high quality product or maintaining high productivity.

SUMMARY OF THE INVENTION

The invention is directed to an improved method of producing cold drawn tubes with a stepped inner diameter. The method obviates the difficulties of positioning a mandrel plug to correctly compensate for the location of the preliminary step within the tube hollow.

A preliminary internal step is formed within a tube shell. The tube shell is oriented with its thicker cross section placed within the die opening which is composed of a conical approach zone and a cylindrical die land. A mandrel is positioned within the die inside of the tube hollow. The mandrel contains a mandrel plug composed of a first cylindrical working section and a second larger diameter cylindrical working section. A conical section joins the first working section to a cylindrical spacer section which is disposed in between the conical section and the larger diameter working section. The mandrel plug, in one embodiment, is connected at its larger diameter end to an elongated mandrel rod. The mandrel plug is prepositioned relative to the die opening so that the travel of the plug is stopped when the larger diameter working section achieves a position within the die land. An external force applied to the rod urges the mandrel toward the die land as the tube hollow is drawn therethrough. The smaller diameter cylindrical section of the plug reduces thicker portion of the tube hollow wall as it is drawn through the die in a manner similar to a stationary mandrel. The reaction of the conical section of the mandrel plug with the wall of the thicker portion prevents the plug from being pulled through the die opening by the frictional forces which arise between the inside surface of the hollow and the cylindrical section of the mandrel, and by the continuing external force applied to the rod. As the tube hollow continues to pass through the die, the preliminary step and the succeeding larger diameter part of the tube reach the die. The resistance of the thicker portion of the tube wall to the conical section of the plug is eliminated as the thinner portion enters the die. Further drawing of the tube through the die allows the larger diameter cylindrical section of the plug to automatically float into the pre-position and to begin further reduction of the larger internal diameter section of the tube hollow.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

Figure 1:
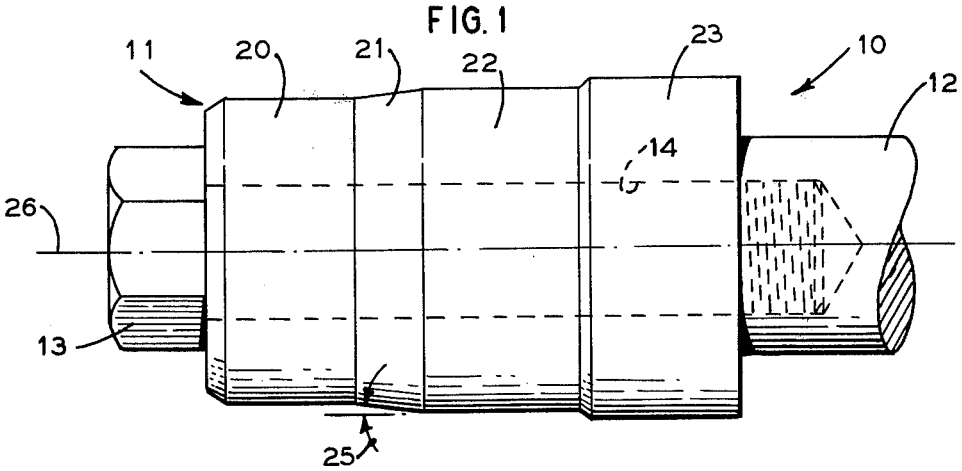
FIG. 1 is a side view of part of a mandrel constructed in accordance with the principles of the invention.

Referring now to the drawings in detail, FIG. 1 illustrates a mandrel 10 employed in the reduction of tubular walls in accordance with the principles of the invention. The mandrel 10 is essentially composed of a mandrel plug 11 and a mandrel rod 12.

The plug 11 is fastened to the rod 12 by a bolt 13 which passes through a central longitudinal plug bore 14 and threadably engages the rod 12. The plug 11 has a first cylindrical working or bearing section 20 connected to a cylindrical spacer section 22 of enlarged diameter by a cone section 21 in the shape of a conical frustrum. The tapered surface of the cone section is formed with a semi-angle 25 with respect to the longitudinal axis 26 of the plug. The spacer 22 is connected, in turn, to a larger diameter cylindrical working or bearing section 23. The cylindrical bearing sections 20, 23 of the mandrel plug are designed to reduce tubular walls in a manner analogous to a fixed mandrel.

Figure 2:
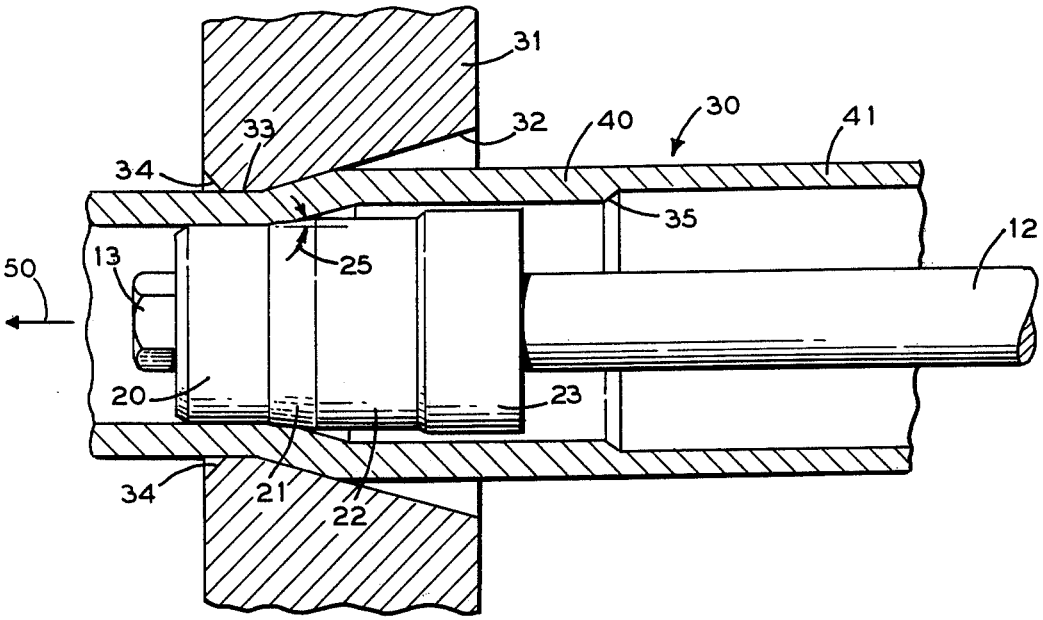
FIG. 2 is a side view, partly in section, showing a first portion of a tube hollow being drawn by a mandrel made and operated in accordance with the invention.

In FIG. 2, a tube hollow 30 is being drawn through a conventional die 31 by pulling means (not shown) such as are well known in the art. The die 31 has a die opening that includes a conical approach zone 32, a cylindrical die land 33, and a countersunk exit zone 34.

It will be understood that the tube hollow 30 has a generally uniform outer diameter prior to insertion into the die. The internal diameter of the tube hollow 30 is formed with a preliminary step at 35 which defines an interface between a first portion 40 which has a greater cross section or smaller internal diameter in comparison with a second portion 41 of the tube hollow 30.

The mandrel 10 is longitudinally translated by known drive means, such as an electrically operated pneumatic cylinder coupled to the end (not shown) of the mandrel rod 12 opposite the plug end. In the preferred embodiment, the mandrel 10 is pre-positioned to limit its forward travel into the die to a point at which the larger diameter working section 23 is properly positioned for drawing within the die opening. The cylindrical working section 20 is dimensioned to reduce the larger cross sectional portion 40 of the tube hollow, and the larger cylindrical working section 23 is likewise dimensioned to reduce the portion 41.

In operation, as is shown in FIG. 2, a tube hollow 30 is inserted into the opening of the die 31 and the mandrel 10 is positioned therein. As drawing of the tube hollow 30 in the direction of arrow 50 commences, the cylindrical working section 20 of the plug moves to position within the die opening under the influence of the forces of the drive means and of the friction arising between the inside surface of the tube hollow 30 and the cylindrical working section 20 of the mandrel plug.

Figure 3:
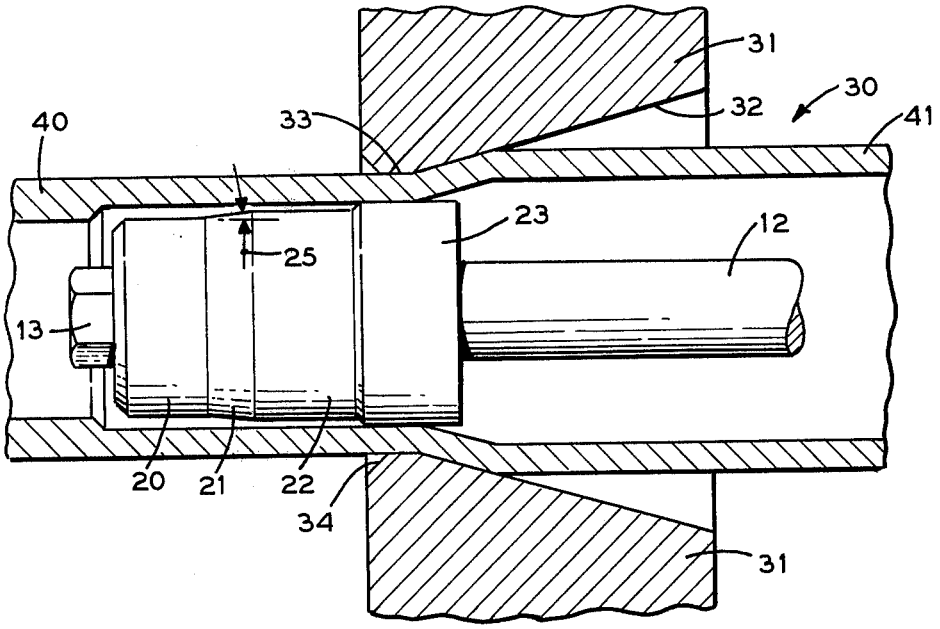
FIG. 3 is a side view, partly in section, showing a second portion of the tube hollow of FIG. 2 being drawn.

Although the drive means continues to push the mandrel forward, the mandrel is prevented from completing its travel, to the pre-positioned setting of cylindrical working surface 23 within the die land 33, by the reaction of the plug cone section 21 with the localized reduction (necking) of the cross section of the tube hollow which occurs within the conical approach zone 32. As the movement of the tube hollow in the direction of arrow 50 continues, the preliminary step 35 enters the die land. At this point, the cross section of the necking, the part of the hollow within the necking reacting with the cone section of the plug, is relatively decreased allowing the plug to advance or float forward further into the die such that the cylindrical working section 23 commences reduction of the portion 41 as is best shown in FIG. 3. Hence, the plug automatically and accurately adjusts itself relative to the preliminary step. Successive reductions can be accomplished by using a mandrel having larger diameter bearing sections.

It is essential that the larger cylindrical working section 23 not enter the die land 33 until the tube hollow is in position for drawing the reduced portion 41. Thus, in the preferred embodiment, the semi-angle 25 of the cone section 21 and the length of the spacer section 22 of the plug 11 are critical. If the true length of any line on the generatrix of the surface of the cone section 21 is extended, it must not intersect the cylindrical surface of the cylindrical working section 23. Stated otherwise, the larger diametrical end of the cone section 21 is spaced a distance from the cylindrical working section 23 by the spacer section 22, and the surface of the cone section 21 is defined by the revolution of a straight line about the axis 26 of the plug 11 at angle 25 with respect to that axis, such that if extended and connected to the axis, is greater than an angle formed by a straight line from the aforementioned connection point to a point on the cylindrical surface of the bearing section 23.

The semi-angle 25, moreover, as generally practiced in the case of conventional floating plugs, should be less than the semi-angle (not shown) of the taper of the conical approach zone wall of the die. The leading edge of each cylindrical working section 20, 23 is beveled, in the preferred embodiment, to facilitate positioning of the plug within the tube hollow without damaging the tube.

The following example illustrates, without limiting the invention as described and claimed, the details of a stepped tube operation which was performed in accordance with the principles of the invention.

EXAMPLE

A 6.000 inch outside diameter tube hollow with a 0.490-inch initial wall thickness was subjected to a first draw pass to form a preliminary step. A first portion of the tube hollow was sunk drawn and a conventional mandrel, having a 4.900-inch diameter, was used to reduce a second part of the wall thickness to 0.360-inches. The outer diameter was uniformly reduced to 5.620-inches. The tube hollow was subjected to a second, third and fourth draw pass utilizing a mandrel plug designed in accordance with the invention and subjected to a rod push force. All dimensions are in inches. The hollow was annealed between passes.

| Pass Number | Tube Hollow Initial O.D. | Tube Hollow Final O.D. | Final Wall Thicknesses | Mandrel/Plug Working Surface Diameters |
|---|---|---|---|---|
| 2 | 5.620 | 4.960 | .465/.260 | 4.030/4.440 |
| 3 | 4.960 | 4.280 | .465/.175 | 3.350/3.930 |
| 4 | 4.280 | 3.510 | .443/.156 | 2.624/3.198 |

The invention is further exemplified, but not limited, by a mandrel plug constructed with the following dimensions:

| | |
|---|---|
| Overall Length | 7.000-inches |
| Cylindrical Working Section (23): | |
| Length (including 1/8-inch, 30 degree bevel) | 2.125-inches |
| Diameter | 4.441-inches |
| Spacer (22) | |
| Length | 2.125-inches |
| Diameter | 4.220-inches |
| Cone Section (21) | |
| Length | 0.875-inches |
| Semi-Angle | 6-degrees |
| Cylindrical Working Section (20): | |
| Length (including 1/4-inch, 30 degree bevel) | 1.875-inches |
| Diameter | 4.032-inches |
| Plug Bore (14) Diameter | 1 13/16-inches |

I claim:

1. A method of tube drawing to produce a cold finished stepped internal diameter tube, which comprises: positioning within an opening of a die a tube hollow consisting essentially of a section having a uniform outer and stepped inner diameters greater than the outer and inner diameters of the finished tube; positioning within the tube hollow a mandrel including a mandrel plug and a mandrel rod connected to the mandrel plug, the mandrel plug having a first cylindrical working surface, a second larger diameter cylindrical working surface and plug means for automatically positioning the first cylindrical working surface and the second cylindrical working surface within the die opening; and causing relative movement of the tube hollow with respect to the die, in one draw pass, with the plug means automatically positioning the first cylindrical working surface to reduce the wall of a first portion of the tube hollow section and with the plug means further automatically positioning the second cylindrical working surface to reduce the wall of a second portion of the tube hollow section such that the outer diameter is uniformly reduced and the inner diameters are successively reduced.

2. A drawing method as recited in claim 1, wherein the first portion of the tube hollow section has a uniform inner diameter differing from a uniform inner diameter provided in the second portion of the tube hollow section.

3. A drawing method as recited in claim 2, wherein the plug means for automatically positioning the first cylindrical working surface and the second cylindrical working surface within the die opening includes a cylindrical spacer section, a conical frustum section extending between one end of the first cylindrical working section and one end of the cylindrical spacer section; and, the second larger diameter cylindrical working section extends from the other end of the cylindrical spacer section.

4. A drawing method as recited in claim 3, wherein the conical frustum shaped section has a surface of revolution such that the angle which is formed with the longitudinal axis of the plug by a straight line lying in the surface of revolution and drawn to a point on the axis is greater than an angle drawn from the axis point to any point on the cylindrical surface of the second larger diameter cylindrical working section.

5. A drawing method as recited in claims 1 or 2 or 2 or 3 further comprising applying an external force to the mandrel rod to urge the mandrel toward the die land as the tube hollow is drawn therethrough.

6. The drawing method as recited in claim 5, further comprising prepositioning the mandrel plug relative to the die opening and limiting the travel of the plug such that the travel is stopped when the larger diameter cylindrical working section achieves a position within the die land.

* * * * *